US008472659B2

(12) United States Patent
Liow et al.

(10) Patent No.: US 8,472,659 B2
(45) Date of Patent: Jun. 25, 2013

(54) MULTIMODE AUDIO REPRODUCTION DEVICE

(75) Inventors: Yuen-Khim Liow, Singapore (SG); Siang Thia Goh, Singapore (SG); Eng Kim Teo, Singapore (SG); Wee Chong Ou, Singapore (SG)

(73) Assignee: Creative Technology Ltd, Singapore (SG)

( * ) Notice: Subject to any disclaimer, the term of this patent is extended or adjusted under 35 U.S.C. 154(b) by 1402 days.

(21) Appl. No.: 11/107,615

(22) Filed: Apr. 15, 2005

(65) Prior Publication Data

US 2006/0233388 A1 Oct. 19, 2006

(51) Int. Cl.
*H04R 25/00* (2006.01)

(52) U.S. Cl.
USPC ..... 381/383; 381/74; 381/123; 381/150

(58) Field of Classification Search
USPC ..... 381/74, 182, 370, 383, 379, 374, 381/386, 373, 150, 334, 123; 379/433.01–433.09, 433.11–433.13, 433.1, 379/428.01
See application file for complete search history.

(56) References Cited

U.S. PATENT DOCUMENTS

| | | | | | |
|---|---|---|---|---|---|
| 4,412,106 | A | * | 10/1983 | Pavel | 381/309 |
| 4,821,318 | A | * | 4/1989 | Wu | 379/430 |
| 4,907,266 | A | * | 3/1990 | Chen | 379/430 |
| 5,099,519 | A | * | 3/1992 | Guan | 381/378 |
| 5,177,784 | A | * | 1/1993 | Hu et al. | 379/430 |
| 5,333,206 | A | * | 7/1994 | Koss | 381/370 |
| 5,684,879 | A | * | 11/1997 | Verdick | 381/370 |
| 5,887,068 | A | * | 3/1999 | Givogue et al. | 381/89 |
| 6,144,738 | A | * | 11/2000 | Hawker et al. | 379/433.02 |
| 7,388,960 | B2 | * | 6/2008 | Kuo et al. | 381/186 |
| 2005/0032500 | A1 | * | 2/2005 | Nashif et al. | 455/345 |

FOREIGN PATENT DOCUMENTS

JP 2000316198 * 11/2000

* cited by examiner

*Primary Examiner* — Vivian Chin
*Assistant Examiner* — Con P Tran
(74) *Attorney, Agent, or Firm* — Creative Technology Ltd

(57) ABSTRACT

A multimode audio reproduction device is disclosed that comprises first and second audio reproduction modules coupled by a support structure. The first and second audio reproduction modules are movable between two configurations. In the first configuration the audio reproduction device serves as a loudspeaker while in the second configuration the audio reproduction device serves as a headphone.

14 Claims, 7 Drawing Sheets

MULTIMODE AUDIO REPRODUCTION DEVICE

FIELD OF THE INVENTION

This invention relates to a multimode audio reproduction device and refers particularly, though not exclusively to an audio reproduction device that can be used both as a headphone and a loudspeaker.

BACKGROUND OF THE INVENTION

The reproduction of audio requires a reproduction device such as, for example, earphones, headphones or one or more loud speakers.

Many people now have one or more of: portable music players, portable media players, portable game consoles and players; portable computers with games, multimedia players including movies, and audio; and the like. This often requires the use of external, attachable speakers for audio reproduction and/or headphones for audio reproduction. Many have both headphones for use when traveling, and speakers for use in offices, hotel rooms, and the like.

SUMMARY OF THE INVENTION

In accordance with a first preferred aspect there is provided an audio reproduction device. The audio reproduction device comprises a first audio driver module and a second audio driver module, as well as a support structure coupling the first and second audio driver modules. The first and second audio driver modules are movable relative to one another between a first configuration in which they are positioned to be used as headphones and a second configuration in which they are positioned to be used as loudspeakers.

The first and second audio driver modules may each include a headphone audio driver and a loudspeaker audio driver. The headphone audio drivers may face generally towards each other and the loudspeaker audio drivers may face generally away from each other when the audio reproduction device is in the first configuration. The first and second audio driver modules may be movable towards each other to assume the second configuration.

The loudspeaker audio drivers of the first and second audio modules may be positioned to project sound in the same general direction when the first and second audio modules are in the second configuration. The loudspeaker audio drivers of the first and second audio modules may be positioned to project sound in the same general direction when the first and second audio modules are in the second configuration.

The audio reproduction device may further comprise a switch to disable the loudspeaker audio drivers when the audio reproduction device is in the first configuration and to disable the headphone audio drivers when the audio reproduction device is in the second configuration. The switch may operate automatically as the first and second audio modules are moved between configurations.

The first and second audio modules may engage each other in the second configuration so that they maintain their relative position. The support structure may serve to prop up the first and second audio modules when in the second configuration and as a headband for the first and second audio driver modules when in the first configuration.

The audio reproduction device may further comprise circuitry for wireless reception of audio. The circuitry may include a processor for decompressing compressed audio data.

The first and second audio driver modules may each comprise an enclosure. Each enclosure may comprise a front face and a rear face. The loudspeaker audio drivers may be mounted in the front faces, and the headphone audio drivers may be mounted in the rear faces.

The loudspeaker audio drivers may be operative when the first and second audio driver modules are in the second configuration but may not be operative when the first and second audio driver modules are in the first configuration. The headphone audio drivers may be operative when the first and second audio driver modules are in the first configuration. Preferably, the headphone audio drivers are not operative when the first and second audio driver modules are in the second configuration.

At least one of the enclosures may further comprise a detector for detecting whether the first and second audio driver modules are in the first configuration or the second configuration. The support structure may be pivotally connected to the enclosure of both the first and second audio driver modules.

Each enclosure may further comprise an end, and each end may comprise a retainer for releasably retaining the end of the first audio driver module with the end of the second audio driver module when the first and second audio driver modules are in the second configuration. The retainer may be a tongue and a complementary groove, or a pin and a complementary hole. Also, there may be an ear pad mounted to the rear face co-axial with the headphone audio driver.

There may be at least one internal baffle within each enclosure located between the headphone audio driver and the loudspeaker audio driver. The at least one baffle may divide each enclosure into two sub-enclosures: a first sub-enclosure for the headphone audio driver, and a second sub-enclosure for the loudspeaker audio driver.

According to a second preferred aspect there is provided an audio reproduction device comprising a first audio driver module and a second audio driver module with the first and second audio driver modules being movable relative to one another between a first configuration and a second configuration. At least one of the first and second audio driver modules comprises audio processing circuitry for processing audio supplied to the device. The audio processing circuitry comprising an amplifier, the amplifier being for responding to an input to automatically limit an output of the amplifier when the device is in the first configuration.

Each of the first and second audio driver modules may comprise an enclosure with each enclosure having an end. The input may be from a detector mounted on the end of at least one of the enclosures. The audio processing circuitry may further comprise a switch for receiving an output from the detector and providing the input.

BRIEF DESCRIPTION OF THE DRAWINGS

In order that the invention may be fully understood and readily put into practical effect, there shall now be described by way of non-limitative example only a preferred embodiment of the present invention, the description being with reference to the accompanying illustrative drawings.

In the drawings:

FIG. 6(*a*) is a view corresponding to FIG. 6 but of an alternative embodiment;

DETAILED DESCRIPTION OF THE PREFERRED EMBODIMENTS

Figure 1:
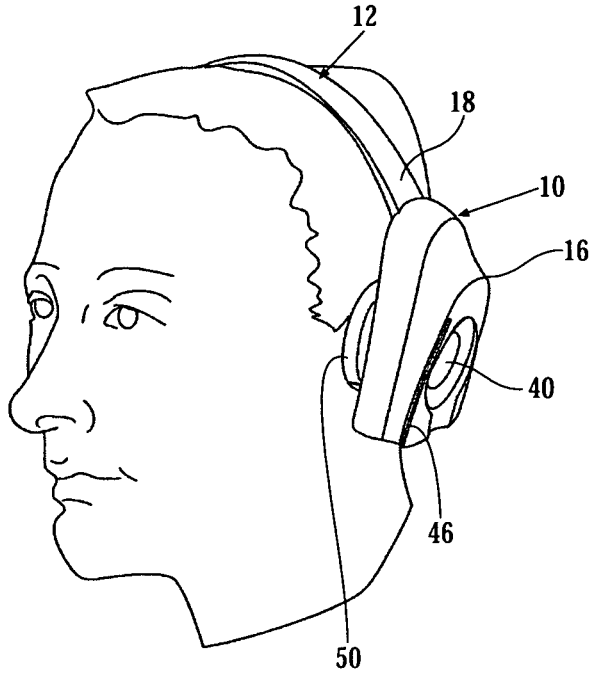
FIG. 1 is a front perspective view of a first embodiment of the audio reproduction device in a first mode.
Figure 3:
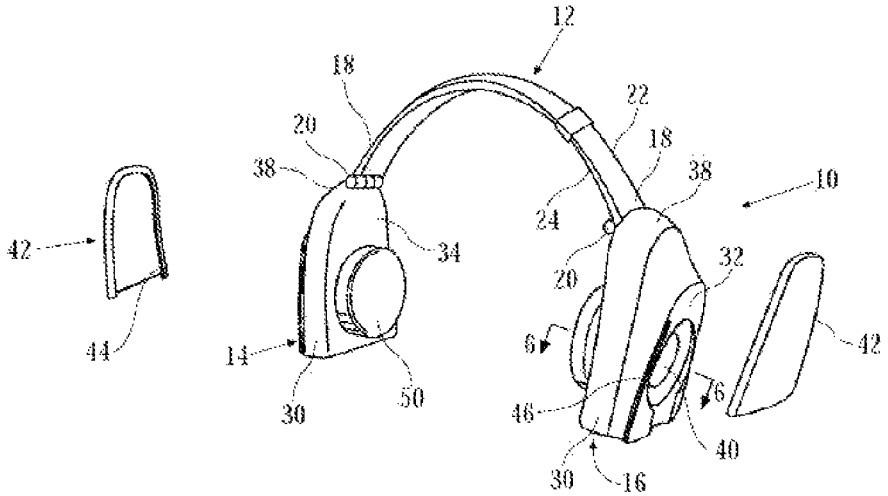
FIG. 3 is a view corresponding to FIG. 1.

To refer to FIGS. 1 and 3, there is shown a multimode audio reproduction device able to be used in two modes: a first mode or configuration in which it is usable as a headphone, and a second mode or configuration in which it is usable as a loudspeaker.

FIG. 1 shows the audio reproduction device in a first configuration in which it functions as a headphone. The audio reproduction device 10 includes a head band 12 extending between and pivotally connected to a first audio reproduction module 14 and a second audio reproduction module 16. At each end 18 of the head band 12 there is a pivotal or hinged connection 20 between the head band 12 and the respective audio reproduction module 14, 16.

The head band 12 has a first portion 22 and a second portion 24 that are slidable relative to each other to enable the effective length of the head band 12 to be varied. This enables the head band 12 to be adjusted to suit a user's head. The first portion 22 and second portion 24 may engage each other telescopically.

Each audio reproduction module 14, 16 comprises an enclosure 30 having a front face 32, a rear face 34, an end face 36 and a top 38. The pivotal connection 20 is preferably on rear face 34 at or adjacent the top 38.

Mounted in and/or to front face 32 is at least one loudspeaker driver 40. Although a single driver 40 is shown, there may be more than one driver 40 in front face 32.

To protect the driver 40, a removable cover 42 is provided to cover at least that part of front face 32 in which the driver 40 is located. The cover 42 may be removably attached using any known, suitable retainer such as, for example, Velcro™, bayonet fittings, clips, snap fittings, or the like. As shown, the cover 42 has a rim 44 that is a snap fit over peripheral edge 46 of front face 32.

Mounted to rear face 34 is an ear pad 50. The ear pad 50 may be of the "rest on the ear" style (as shown) or may be of the type than encompasses the ear. Ear pad 50 may be releasably attached to rear face 34 by a mount 52. The mount 52 may be in a form of a short hollow cylinder to which ear pad 50 is attached. Mounted in and/or to rear face 34 and substantially co-axial with ear pad 50 as well as mount 52 is a headphone driver 54. Audio as reproduced by headphone driver 54 can pass through mount 52 and ear pad 50 and be heard by a user. Headphone driver 54 may be mounted in or to the enclosure 30 so that the enclosed volume of enclosure 30 provides an improved acoustic response, for example in lower frequencies.

Figure 4:
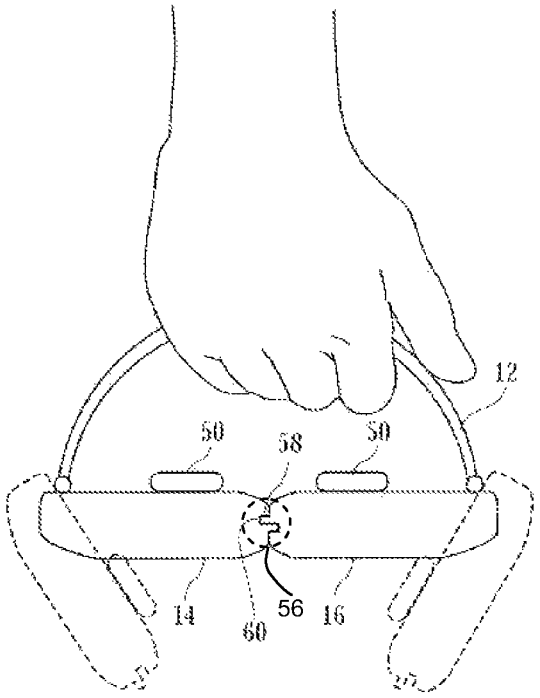
FIG. 4 is a side view of the first embodiment in a third mode.
Figure 6:
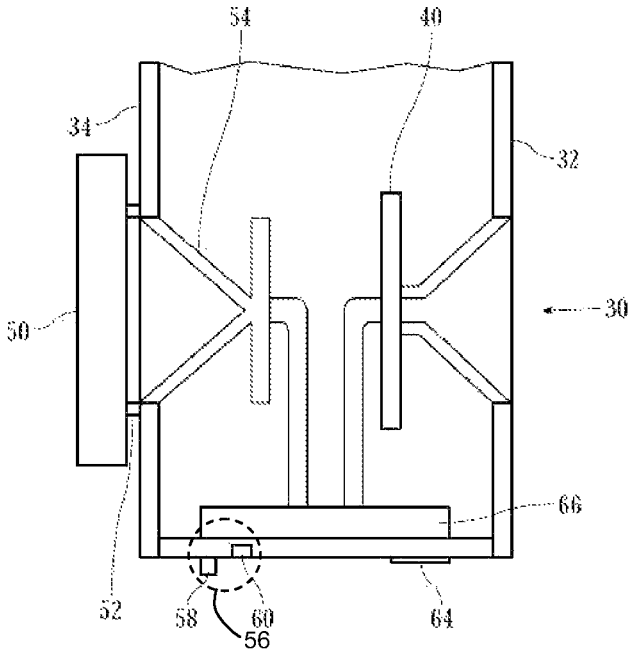
FIG. 6 is a partial cross-sectional view along the lines and in the direction of arrows 6-6 in FIG. 3.
Figure 6A:
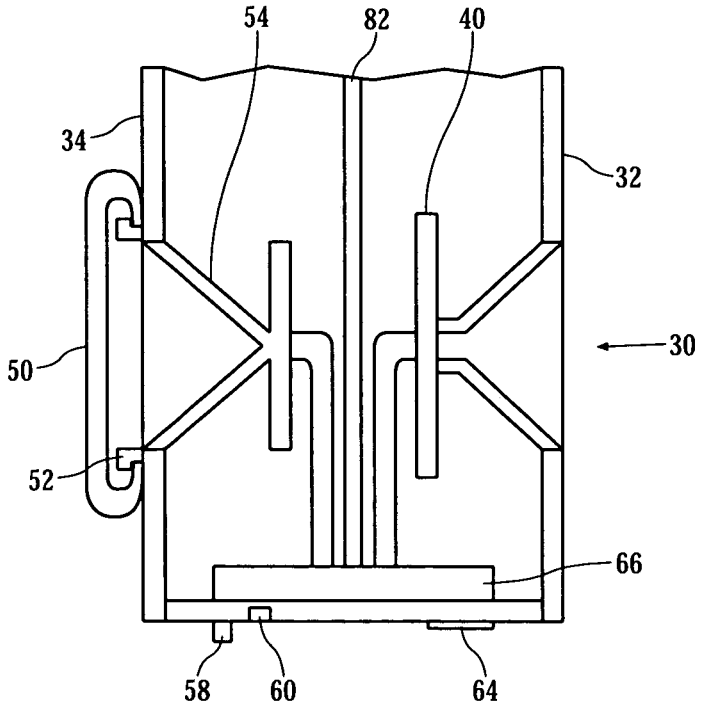

The end 36 of each audio reproduction module 14, 16 has a retainer 56. As shown in FIGS. 4 and 6, this comprises complementary tongues 58 and grooves 60 engaging in the manner of a snap or sliding fit. In this way the two ends 36 can be brought together and the tongues 58 engaged in grooves 60 for the two audio reproducing modules 14, 16 to be releasably secured together with rear faces 34 being generally co-planar, and ends 36 being adjacent each other or even in contact with each other.

Figure 2:
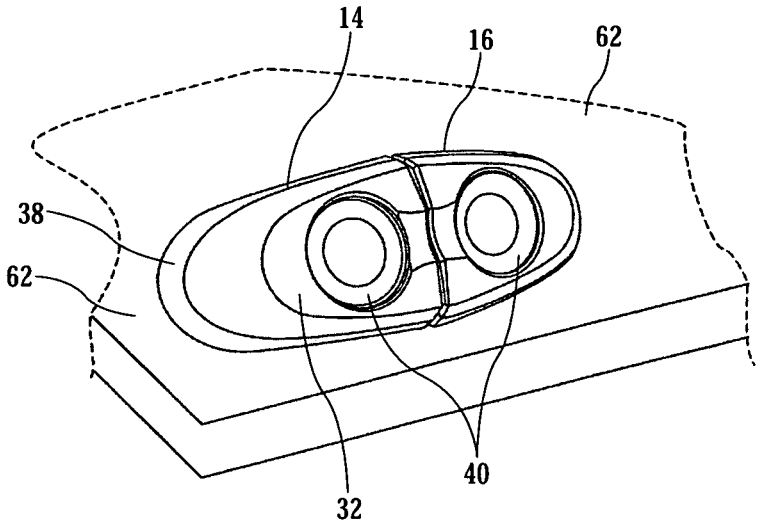
FIG. 2 is a front perspective view of the first embodiment in a second mode.
Figure 5:
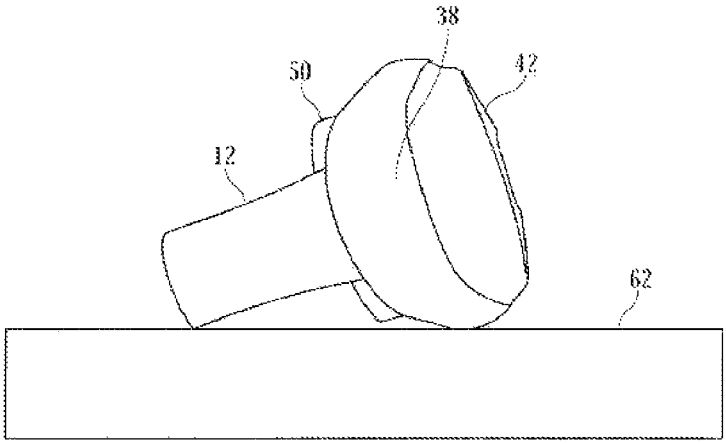
FIG. 5 is a side view corresponding to FIG. 2.

In this situation, the audio reproduction device 10 is in now in the second mode or configuration in which it serves as a loudspeaker. This is shown in FIGS. 2 and 5. Here, the headband 12 acts as a support or prop so that the audio reproducing modules 14, 16 can be placed on a surface 62 at an angle relative to surface 62 that provides for projection of sound from the drivers 40.

In FIG. 4, the support 12 is used as a carry handle.

Either or both of the ends 36 may have a detector 64 for determining when the ends 36 are engaged and disengaged so that the audio reproduction modules 14, 16 will switch automatically between headphone mode and speaker mode. The detector 64 may be a pressure switch, proximity switch, cams, contacts or the like that automatically connect or disconnect the relevant audio drivers when the audio reproduction modules pivot between the headphone and speaker configurations.

The drivers 40, 54 are shown in more detail in FIG. 6. They may be opposite each other or may be vertically or laterally spaced apart. If desired, a divider or baffle 82 [FIG. 6(*a*)] may be provided between the drivers 40, 54 to improve the acoustic response, and/or to separate or isolate drivers 40, 54 into separate compartments by dividing the enclosure into two sub-enclosures - one for the first driver 40 and one for the headphone driver 54. The baffle or divider 82 may be perforated if desired.

The audio reproduction modules 14, 16 are joined by a cable 76 (FIG. 7) located within headband support 12 in the usual manner. The audio reproduction device 10 receives the audio from an external source, or from an inbuilt MP3, FM radio or like player. If from an external source, it may be by:

(i) a direct connection using relevant connections such as, for example, an USB connection, IEEE 1394 connection, or using RCA or like connections;

(ii) a cable connection using a suitable connector at a remote end, such as a conventional or mini headphone plug. The cable connection may be permanently connected to the audio reproduction device 10 or may be removable by use of an appropriate connector; or (iii) wirelessly using, for example, Bluetooth, Wi-Fi, infrared or magnetic induction. If Bluetooth it may be the A2DP profile for audio.

Figure 7:
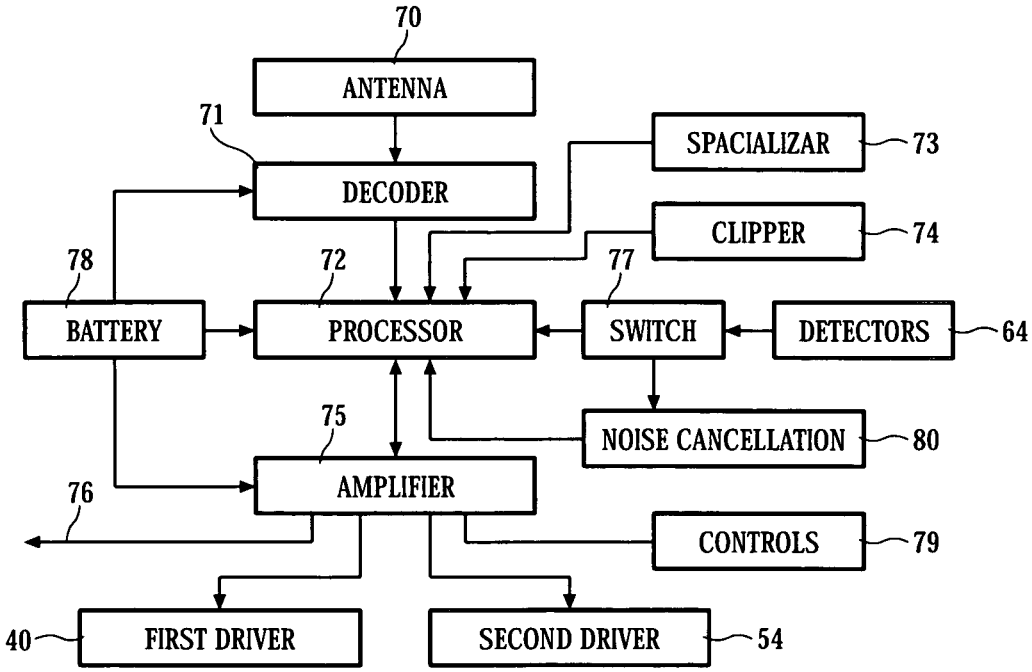
FIG. 7 is an illustration of a preferred form of circuit.
Figure 8:
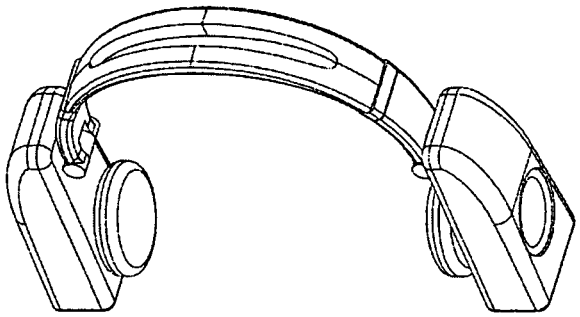
FIG. 8 is a top perspective rear view of a second embodiment when in the first mode.
Figure 9:
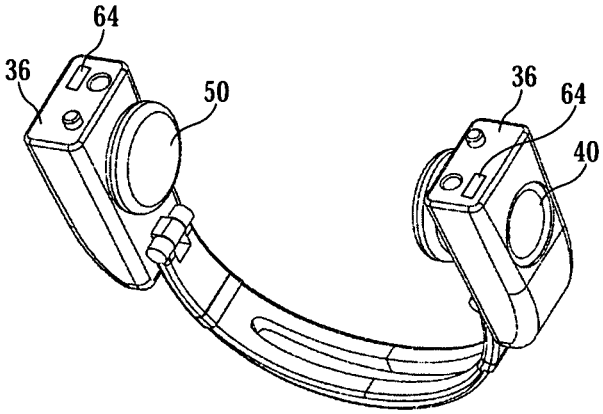
FIG. 9 is an underneath perspective corresponding to FIG. 6.
Figure 10:
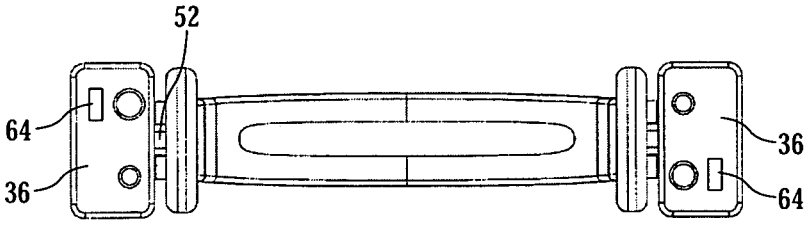
FIG. 10 is an underneath view corresponding to FIGS. 6 and 7.
Figure 11:
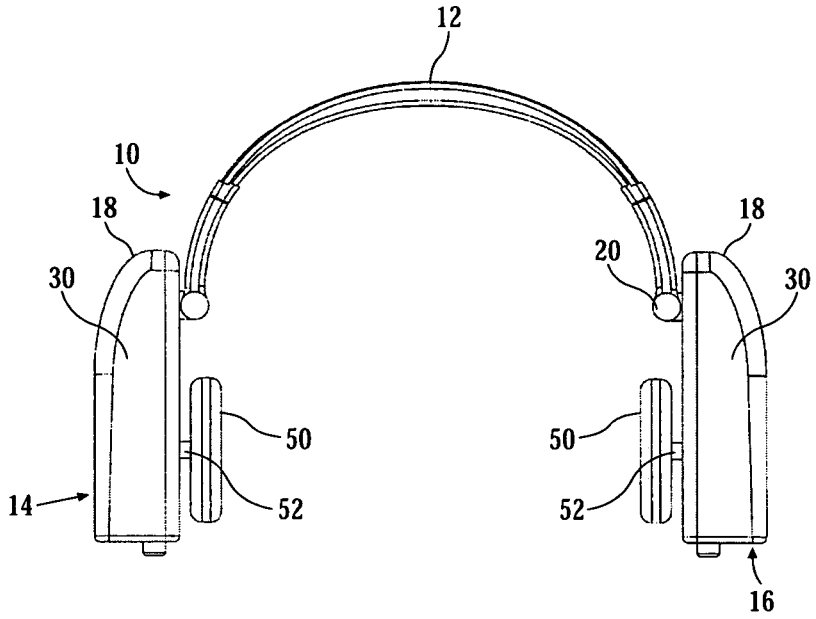
FIG. 11 is a front view corresponding to FIGS. 6 to 8.
Figure 12:
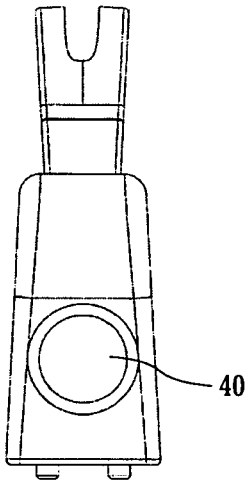
FIG. 12 is a side view corresponding to FIGS. 6 to 9.
Figure 13:
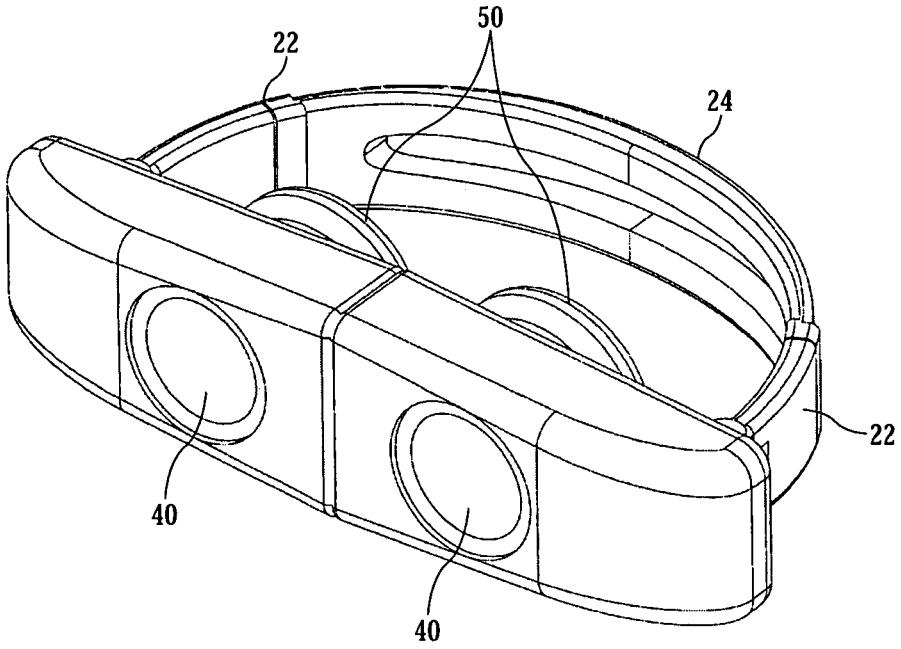
FIG. 13 is a front perspective view of the second embodiment in the second mode.
Figure 14:
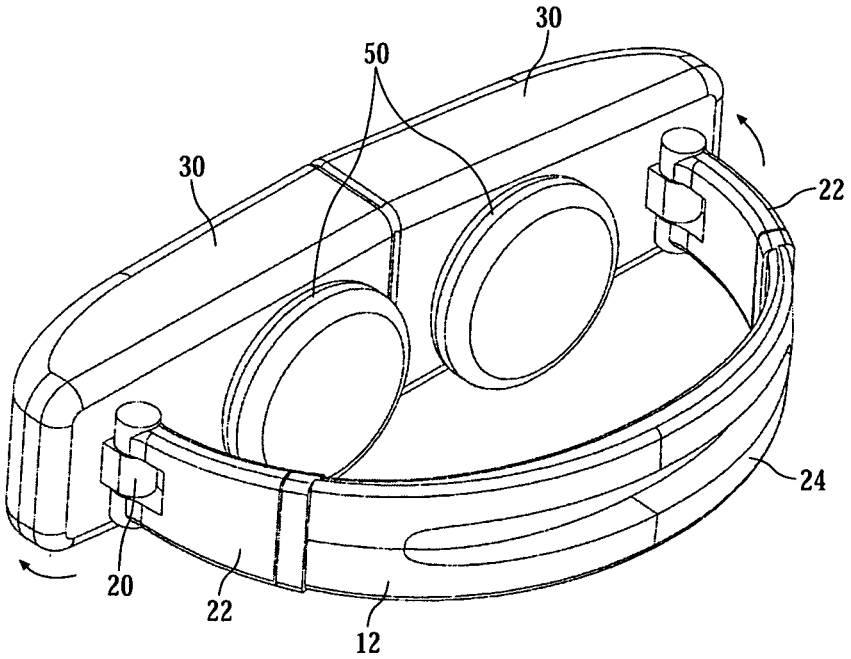
FIG. 14 is a rear perspective view corresponding to FIG. 11.

The audio reproduction device 10 may have appropriate audio processing circuitry 66, as illustrated in FIG. 7. The circuitry is usually provided in one of the audio reproduction modules 14, 16. Included is an antenna 70 for receiving the audio wirelessly and a decoder 71 for decoding the received audio if in an encoded format such as, for example, MP3. A processor 72 controls controls the overall functionality. A spatializer 73 or other audio processor may be used to enhance the user experience. A clipper 74 may be used to prevent overload of the audio drivers. The audio reproduction modules 14, 16 may be powered using an external or internal amplifier, or an internal amplifier. When onboard circuitry is used for wireless audio reception and/or decoding, an onboard amplifier 75 is used to amplify the audio.

The detector(s) 64 is operatively connected to a switch 77 that may be separate to or integral with processor 72. The switch 77 is to enable the processor 72 to determine whether the audio reproduction modules 14, 16 are separate and thus in headphone mode, or are joined and thus in speaker mode. If in headphone mode, the output from amplifier 75 may be limited to protect the hearing of a user. Also, with driver 54 is use as headphones the loudspeaker drivers 40 may be disabled to prevent audio from being reproduced by drivers 40. When in the speaker mode and thus loudspeaker drivers 40 are operative, the headphone drivers 54 may be disabled. Alternatively, when in the speaker mode, the headphone drivers 54 may remain enabled to provide an improved acoustic response from the audio reproduction module 14, 16.

The loudspeaker driver 40 and the headphone driver 54 may be the same but, as their functions are different, they typically have different audio reproduction characteristics. It is normal for the loudspeaker driver 40 to be physically larger, to have a larger power rating, and a relatively wider frequency response than the headphone driver 54. However, the loudspeaker driver 40 may be small physically, and have a frequency response that is better in the higher frequencies than the headphone driver, but may have a lesser frequency response in the lower frequencies. In this way the headphone driver 54 may be also used when in the speaker mode so that the rear-facing headphone driver can reproduce the audio with a better lower frequency response. The reflection of such reproduced audio may have an enhanced low frequency response.

A battery 78 is used to provide the necessary power if required. In one embodiment, the audio reproduction device 10 receives an amplified analog signal directly via a cable (i.e. in conventional headphone manner), and no further power is required. If additional power is required for wireless audio reception, decoding of audio data, or amplification, this may be provided by an external power source (e.g. a battery pack or AC power supply) or an onboard power source such as the battery 78.

Controls 79 for volume and/or balance and/or tone and/or treble and/or bass response may also be provided, if required or desired. Alternatively or additionally, the control of the external source of audio may be used. A noise cancellation feature 80 may also be included.

FIGS. 9 to 14 illustrate a second embodiment that is the same as the first embodiment except that the pivotal connection 20 is of a slightly different form, and the enclosures 30 are of a different shape. Also, the mount 52 is a hollow cylinder of relatively small diameter. In all other respects it is the same as the embodiment of FIGS. 1 to 8.

Whilst there has been described in the foregoing description preferred embodiments of the present invention, it will be understood by those skilled in the technology that many variations or modifications in details of design or construction or operation may be made without departing from the present invention.

The invention claimed is:

1. An audio reproduction device which is operable in one of a first mode and a second mode, the audio reproduction device comprising:

a first audio driver module having a first top and a first end face, the first top and the first end face being at opposite edges of the first audio driver module;

a second audio driver module having a second top and a second end face, the second top and the second end face being at opposite edges of the second audio driver module;

a support structure coupling the first top and the second top, the first top being piviotably coupled to one end of the support structure and the second top being pivotably coupled to another end of the support structure, the first and second audio driver modules being pivotably movable about respective ends of the support structure such that the first end face and the second end face are either apart from each other or in contact with each other; and a detector coupled to at least one of the first end face and the second end face, the detector being operable for determining when the first end face and the second end face are either apart or in contact, wherein when the detector determines that the first and the second end faces are apart, the audio reproduction device operates in the first mode, and wherein when the detector determines that the first and the second end faces are in contact, the audio reproduction device operates in the second mode, the first mode being headphone mode and the second mode being speaker mode.

2. The audio reproduction device of claim 1, wherein the support structure serves to prop up the first and second audio driver modules when the first and the second end faces are in contact, and wherein the support structure serves as a headband when the first and the second end faces are apart.

3. The audio reproduction device of claim 1 further comprising circuitry for wireless reception of audio.

4. The audio reproduction device of claim 3, wherein the circuitry includes a processor for decompressing compressed audio data.

5. The audio reproduction device as claimed in claim 1, wherein at least one of the first and second audio driver modules comprising audio processing circuitry for processing audio supplied to the device;

the audio processing circuitry comprising an amplifier, the amplifier being for responding to an input to automatically limit an output of the amplifier when the device is in the first mode.

6. The audio reproduction device as claimed in claim 5, wherein each of the first and second audio driver modules comprises an enclosure, each enclosure having an end, the input is from a detector mounted on the end of at least one of the enclosures.

7. The audio reproduction device as claimed in claim 6, wherein the audio processing circuitry further comprises a switch for receiving an output from the detector and providing the input.

8. The audio reproduction device as claimed in claim 1, each of the first and the second end faces comprising a retainer, wherein each of the retainer of the first and the second end faces engagingly contact each other when the first and the second audio driver modules are moved into contact with each other.

9. The audio reproduction device as claimed in claim 8, wherein the retainer of each of the first and the second end faces engagingly contact each other such that the first and the second audio driver modules are releasably secured.

10. The audio reproduction device as claimed in claim 9, wherein one of the retainers of the first and the second end faces is a tongue and the other one of the retainers of the first and the second end faces is a groove, the tongue and the groove being complementary to each other.

11. The audio reproduction device as claimed in claim 10, wherein the tongue and the groove are complementary such that the retainers of the first and the second end faces engagingly contact each other in a manner of one of a snap fit and a sliding fit.

12. The audio reproduction device as claimed in claim 1, wherein the first audio driver module has a first front face and a first rear face, the first front face opposing the first rear face, and wherein the second audio driver module has a second front face and a second rear face, the second front face opposing the second rear face.

13. The audio reproduction device as claimed in claim 12, wherein when the first and the second end faces are in contact, the first and second rear faces face toward the support structure, and the first and second front faces face away from the support structure.

14. The audio reproduction device as claimed in claim 12 further comprising:

at least one headphone driver coupled to at least one of the first rear face and the second rear face, operation of the headphone driver being associated with operation of the audio reproduction device in the first mode; and at least one loudspeaker driver coupled to at least one of the first front face and the second front face, operation of the loudspeaker driver being associated with operation of the audio reproduction device in the second mode.

* * * * *